US005524791A

United States Patent [19]

Credle, Jr. et al.

[11] Patent Number: 5,524,791

[45] Date of Patent: Jun. 11, 1996

[54] LOW COST BEVERAGE DISPENSER

[75] Inventors: William S. Credle, Jr., Stone Mountain; David S. Rowley, Smyrna, both of Ga.

[73] Assignee: The Coca-Cola Company, Atlanta, Ga.

[21] Appl. No.: 257,756

[22] Filed: Jun. 8, 1994

[51] Int. Cl.[6] ..... B67D 5/56

[52] U.S. Cl. ..... 222/129.1; 222/137; 222/214; 222/325

[58] Field of Search ..... 222/129.1–129.4, 222/137, 145, 214, 325

[56] References Cited

U.S. PATENT DOCUMENTS

| | | | |
|---|---|---|---|
| D. 268,840 | 5/1983 | Reed . | |
| D. 317,695 | 6/1991 | Stern . | |
| 1,553,994 | 9/1925 | Estes | 222/137 X |
| 1,626,544 | 4/1927 | Lorant . | |
| 1,934,623 | 11/1933 | Frick . | |
| 2,685,985 | 8/1954 | Howell, Jr. . | |
| 2,746,642 | 5/1956 | Parks . | |
| 3,207,376 | 9/1965 | Molitor . | |
| 4,363,426 | 12/1982 | Heinzl et al. . | |
| 4,708,266 | 11/1987 | Rudick | 222/214 X |
| 4,753,370 | 6/1988 | Rudick | 222/214 X |
| 4,793,518 | 12/1988 | Burton . | |
| 4,982,877 | 1/1991 | Burton . | |
| 5,114,047 | 5/1992 | Baron et al. . | |
| 5,275,309 | 1/1994 | Baron et al. . | |
| 5,353,963 | 10/1994 | Gorski et al. | 222/129.1 |

*Primary Examiner*—Gregory L. Huson
*Attorney, Agent, or Firm*—Thomas R. Boston

[57] ABSTRACT

A low cost, manually operated, postmix juice dispenser including a water tank manually filled with water and ice, a removable concentrate container, and a water pump and a concentrate pump connected to a manually operated pump handle.

12 Claims, 9 Drawing Sheets

LOW COST BEVERAGE DISPENSER

BACKGROUND OF THE INVENTION

This invention relates to postmix beverage dispensing and in a preferred embodiment to a low cost, manually pumped juice dispenser.

Postmix beverage dispensers, wherein a concentrate, such as orange juice, apple juice, etc. is mixed with cooled water are well-known. Such dispensers include electrically operated vapor/compression refrigeration, a built-in concentrate pump, water metering means, and ratio control means. Using such dispensers only requires a cup to be placed below the dispensing faucet or nozzle and pushing a button. Such dispensers, however, are relatively expensive and are thus not a viable option for a low volume account.

SUMMARY OF THE INVENTION

A low cost, manually operated, postmix beverage dispenser including a water tank manually filled with ice and water, a removable concentrate container, and a water pump and a concentrate pump connected to a manually operated pump handle. The pumps are positive displacement pumps having a volumetric ratio equal to the mixture ratio of the water and concentrate. A beverage is dispensed by placing a cup on the cup rest, or holding it beneath the nozzle, and pumping a pump handle up and down to dispense beverage into the cup. When the water level is low, a lid is removed and water and ice are added to the water tank. When the concentrate is out, or it is desired to change flavors, an access door is opened and the concentrate container is replace with another.

The dispenser can be upgraded with vapor/compression refrigeration, plumbed water tank, an electric motor to drive the pumps or a water powered motor. The concentrate pump can be built-in to the concentrate package or can be separate.

In a preferred application, the dispenser is used to dispense juices; however, it can also be used with other beverages including tea, coffee, sport drinks and even carbonated drinks.

BRIEF DESCRIPTION OF THE DRAWINGS

The present invention will be more fully understood from the detailed description below when read in connection with the accompanying drawings wherein like reference numerals refer to like elements and wherein.

DETAILED DESCRIPTION OF THE PREFERRED EMBODIMENT

Figure 1:
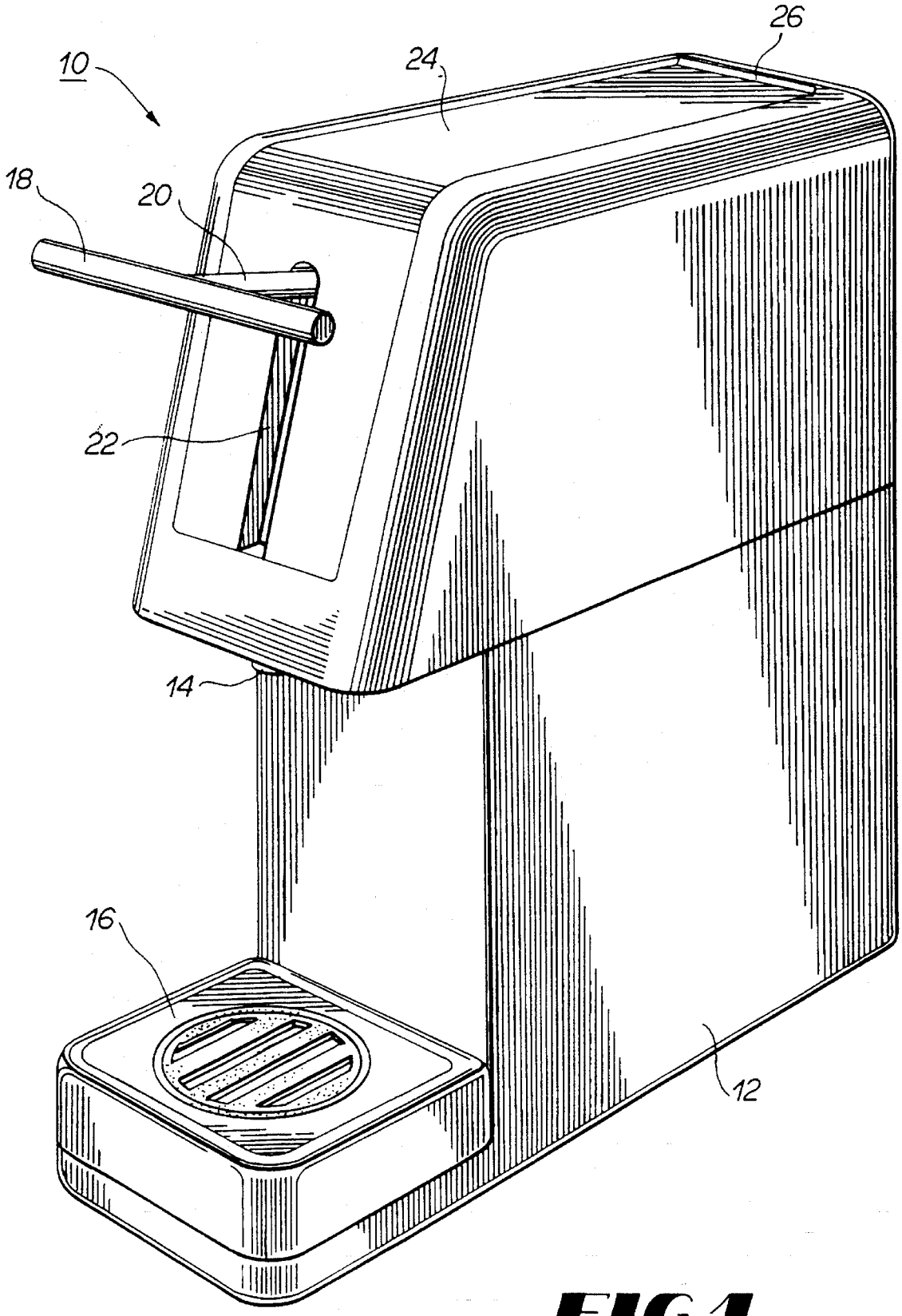
FIG. 1 is a perspective view of a dispenser according to the present invention.
Figure 2:
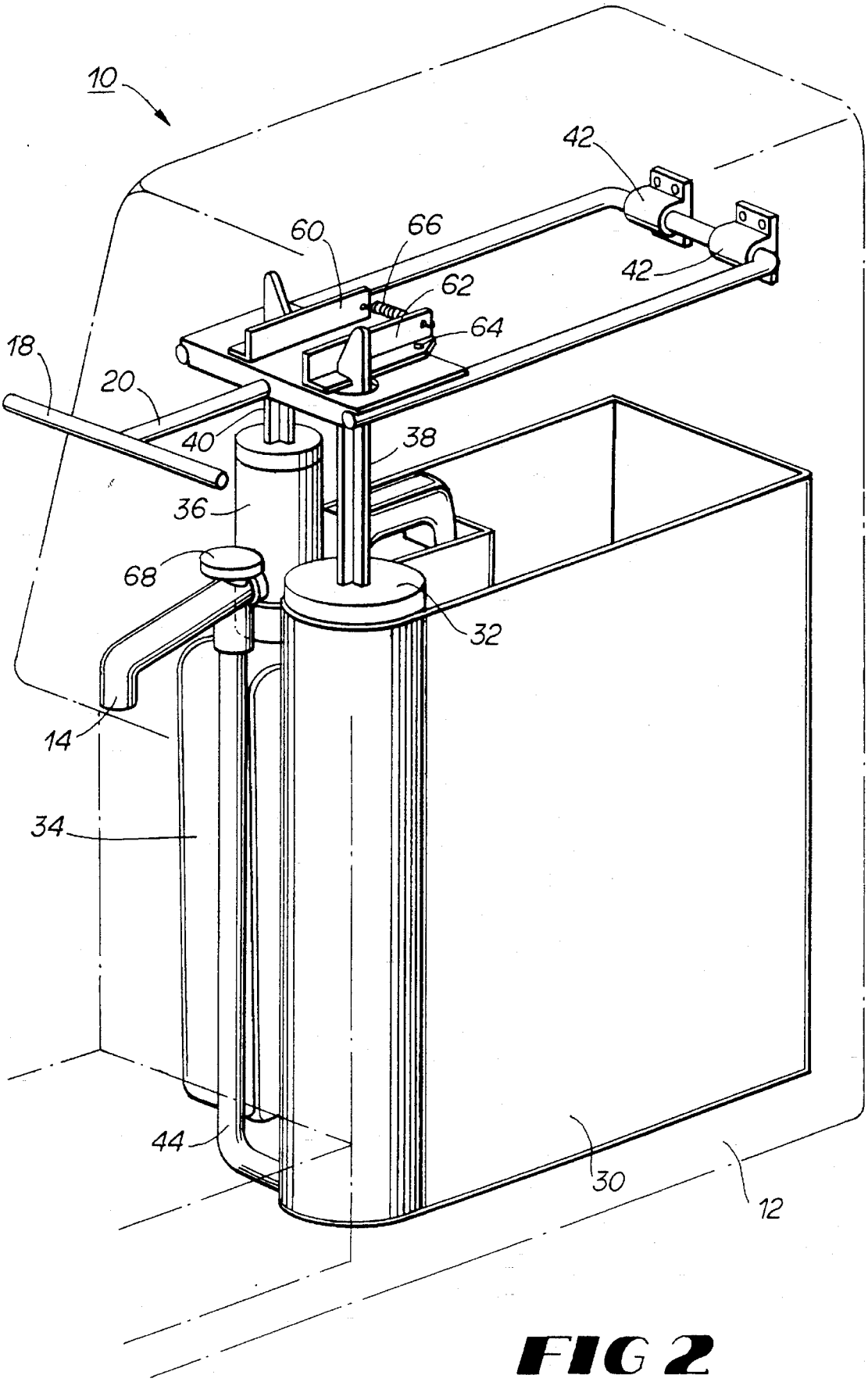
FIG. 2 is a perspective view of the inside of the dispenser of FIG. 1.

With reference now to the drawings, FIGS. 1–5 show a dispenser 10 according to a preferred embodiment of this invention. The dispenser 10 includes a housing 12 having a nozzle 14, a cup rest 16, a pump handle 18 connected to a pump arm 20 extending through an opening 22 in the housing, a housing access door 24 on hinges 26.

Inside the dispenser are a water tank 30, a water pump 32, a concentrate package 34 with a dip tube 35, a concentrate pump 36, a water pump piston rod 38, and a concentrate pump piston rod 40. The pump arm is hingedly connected at 42 to the housing. Water is pumped through line 44 to the nozzle 14. The pumps are one-way piston pumps each with a pair of check valves. The concentrate pump 36 includes a pair of flexible arms 46 and 48 which are moved outwardly when fingers 50 and 52 are squeezed. When released, the arms return and shoulders 54 and 56 snap into a groove 58 on the spout of the package to hold the pump to the package.

To dispense a beverage, a cup is placed below the nozzle and the handle 18 is moved up and down as needed to dispense the amount of beverage desired. If the water is low in the tank, or not cool enough, the door 24 is lifted up and ice and water are dumped into the tank 30. When the concentrate container is empty, the door 24 is lifted, the pump 36 is removed (the water line 44 need not be disconnected) and a new container 34 is positioned in the housing hooked to the pump and the door closed.

The pump arm preferably has a pair of spring biased lever arms 60 and 62 that re squeezed toward each other to release the arm 20 from the pumps (from the pump piston rods 38 and 40) but that automatically re-engage when the arm 20 is pushed down, because of the chamfered top end of the rods 38 and 40. The lever arms fit into slots in the rods 38 and 40. The lever arm 62 is pivoted at 64 and the two arms are biased into contact with the piston rods 38 and 40 by a spring 66.

Figure 3:
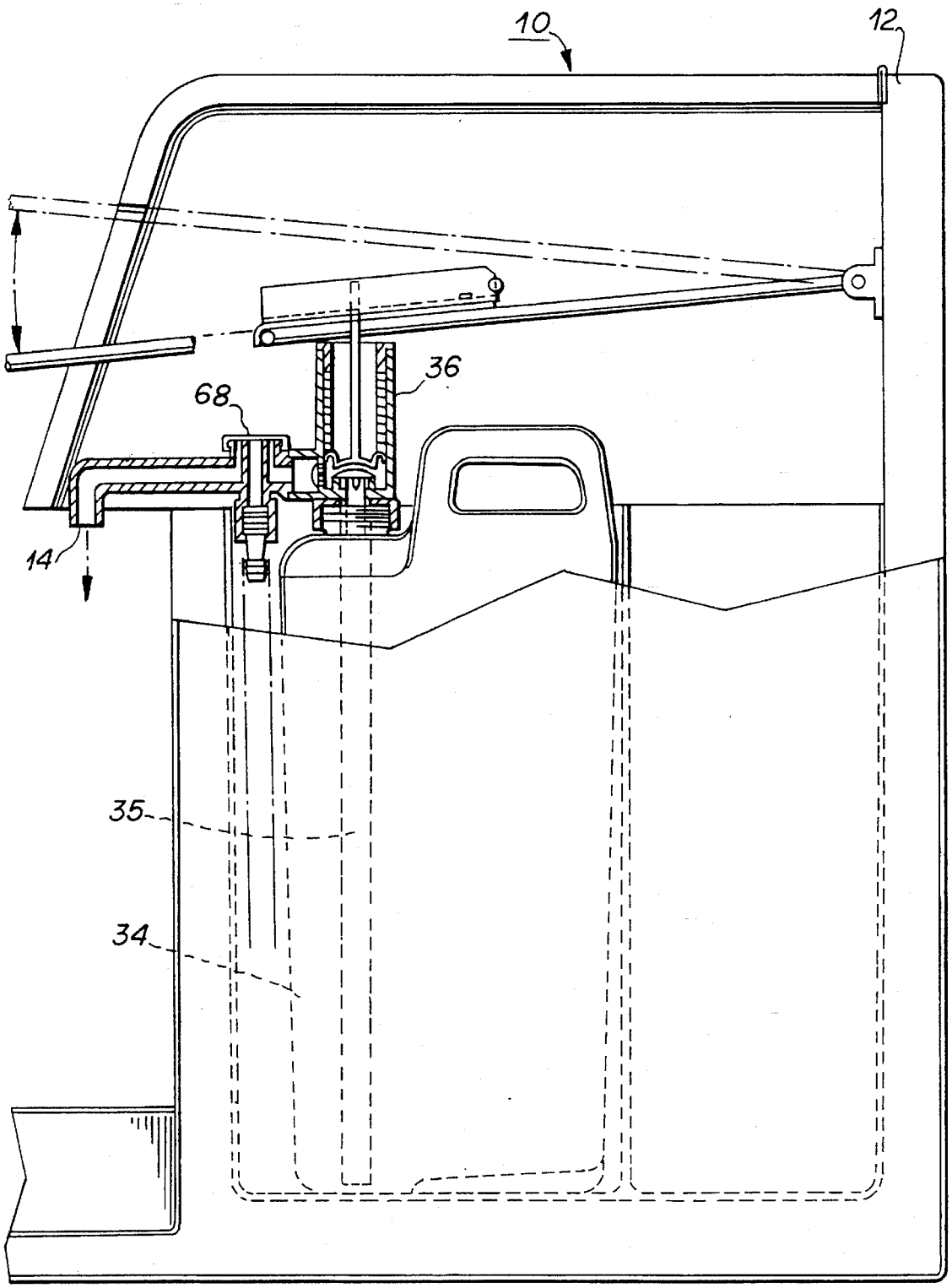
FIG. 3 is a cross-sectional side view through the dispenser of FIG. 1 taken along line 3—3 of FIG. 2.
Figure 4:
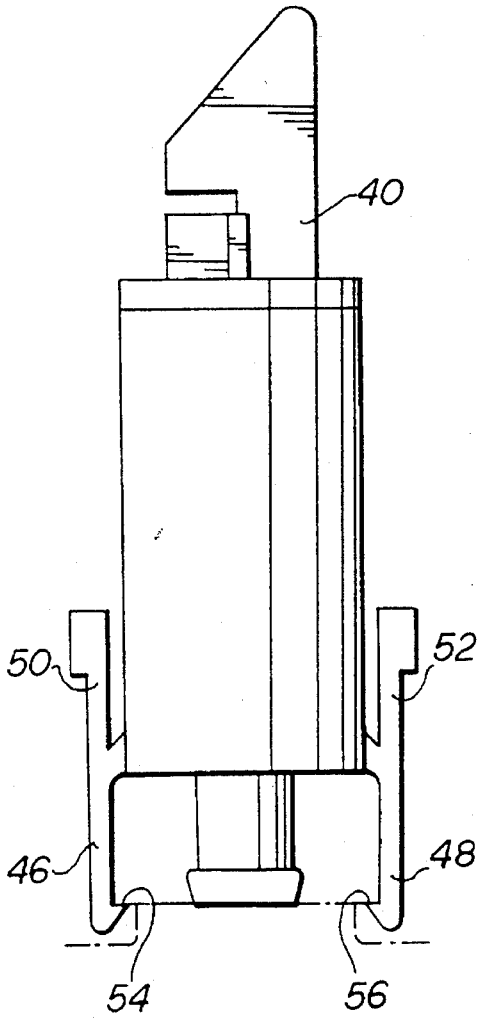
FIG. 4 is a rear view of the concentrate pump of FIG. 3.

The water line 44 connects to the nozzle as shown in FIG. 3. It is normally closed by an elastomeric check valve or cap 68 that is forced up to open when water is pumped up through line 44.

Figure 5:
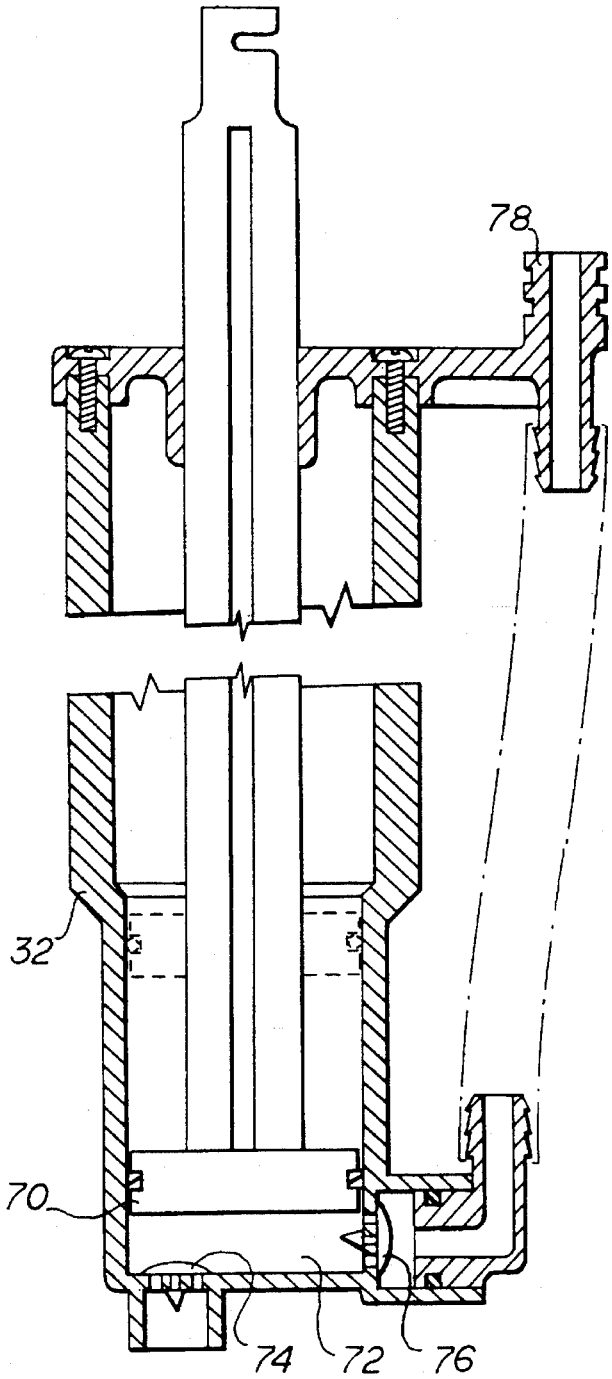
FIG. 5 is a cross-sectional side view through the water pump of FIG. 2 taken along line 5—5 of FIG. 2.

FIG. 5 shows the water pump 32 with a piston 70 connected to the piston rod 38, a pumping chamber 72, an inlet check valve 74, an outlet check valve 76, the water line 44, and a fitting 78 for connecting to the nozzle.

Figure 6:
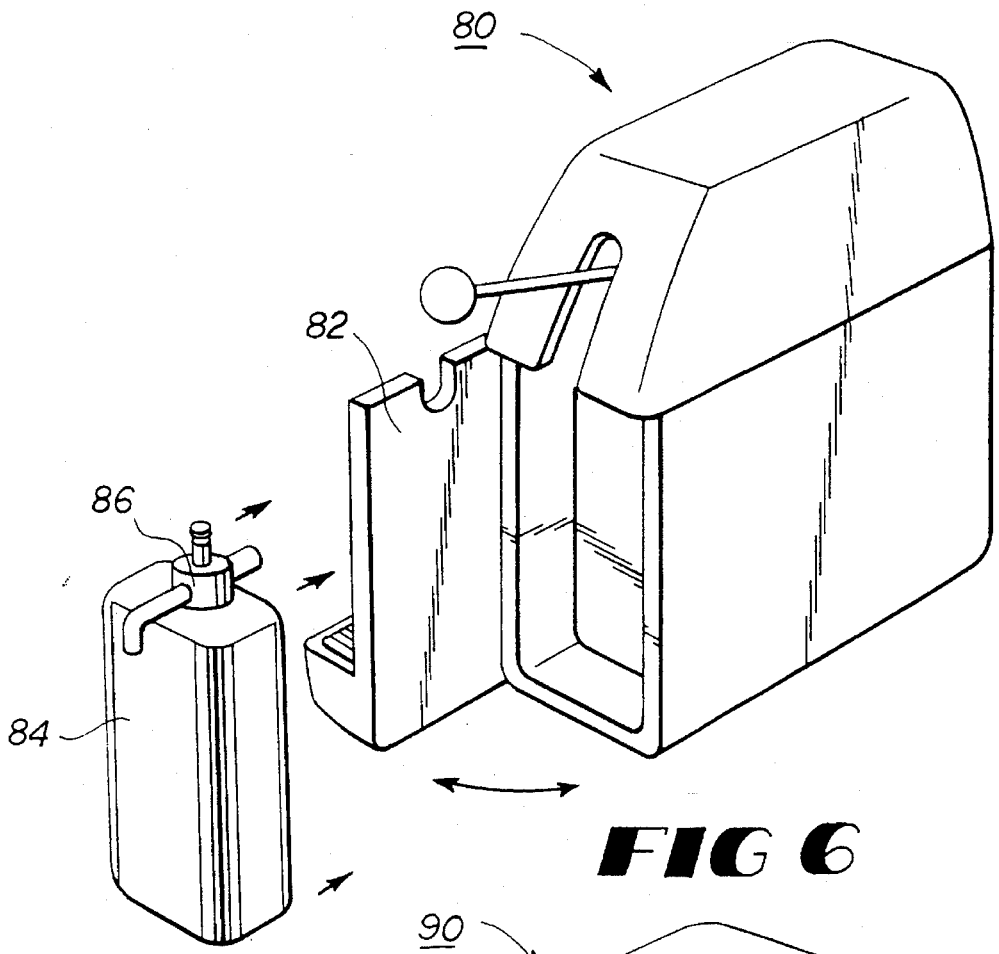
FIG. 6 is a perspective view of a dispenser according to another embodiment of this invention.

FIG. 6 shows a dispenser 80 according to another embodiment of this invention having a front opening door 82 for a concentrate container 84 having a built-in pump 86. The door can alternatively be hinged at the bottom to fold forward and down. The water pump can also slide out the front for cleaning and/or replacement. In all embodiments, the top of the dispenser is preferably a cover that is removable for allowing the water tank to be lifted up and out for cleaning.

Figure 7:
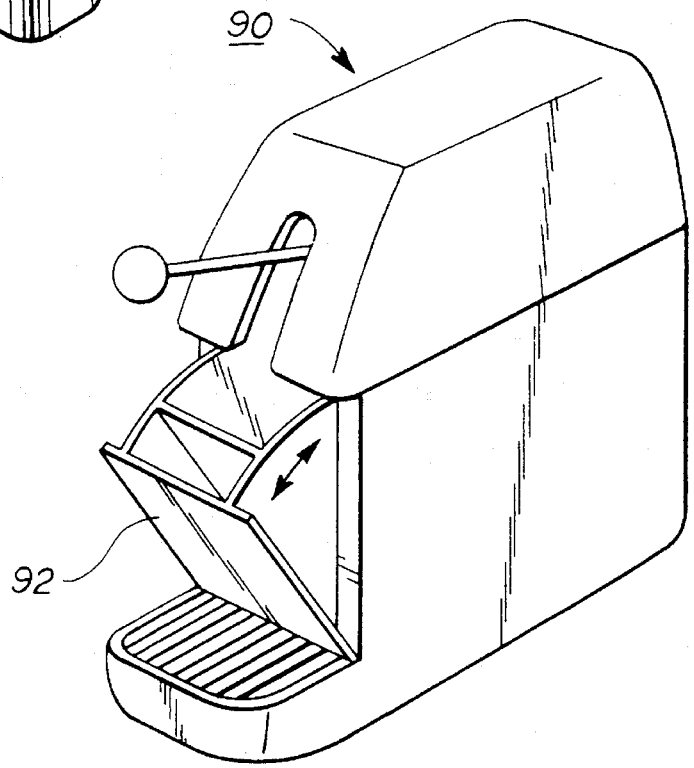
FIG. 7 is a perspective view of yet another embodiment of a dispenser of this invention.

FIG. 7 shows still another embodiment of a dispenser 90 having a front door 92 that pivots out to receive a concentrate container.

Figure 8:
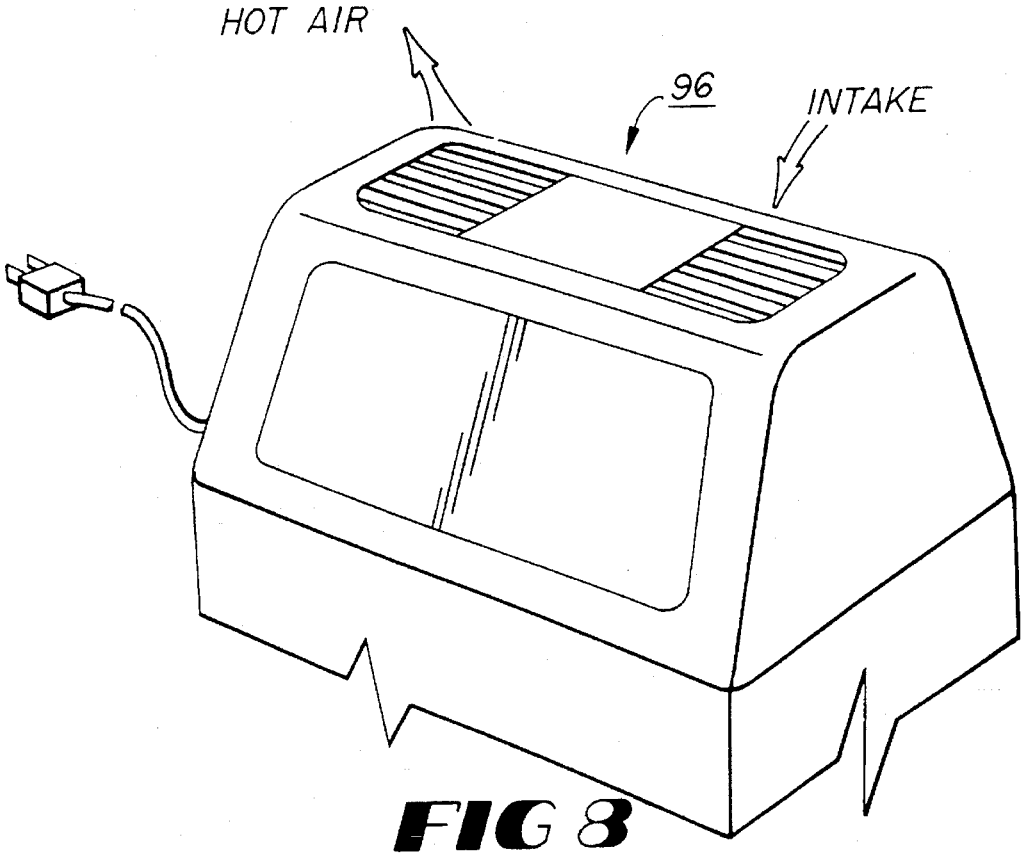
FIG. 8 is a perspective view of a cover of another embodiment of this invention.
Figure 9:
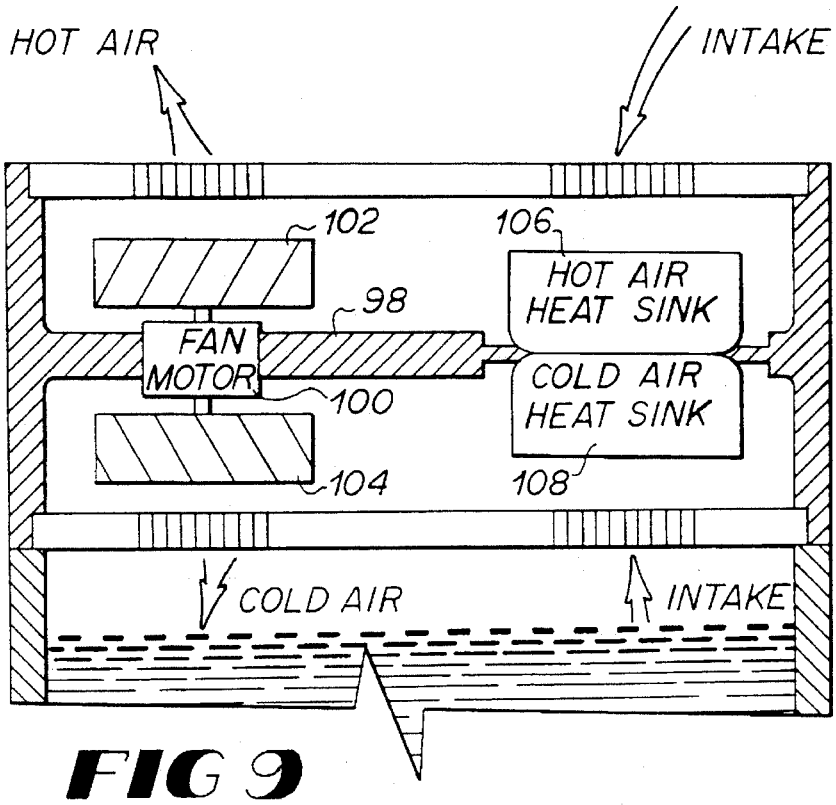
FIG. 9 is a cross-sectional side view through the cover of FIG. 8.

FIGS. 8 and 9 show another embodiment of this invention of a lid or cover 96 for the dispenser 10. The lid 96 has a thermo-electric cooling means for blowing cold air over the top of the water in the water tank. The lid 96 includes a wall 98. A fan motor 100, a hot air fan 102, a cold air fan 104, a hot air heat sink 106, and a cold air heat sink 108.

Figure 10:
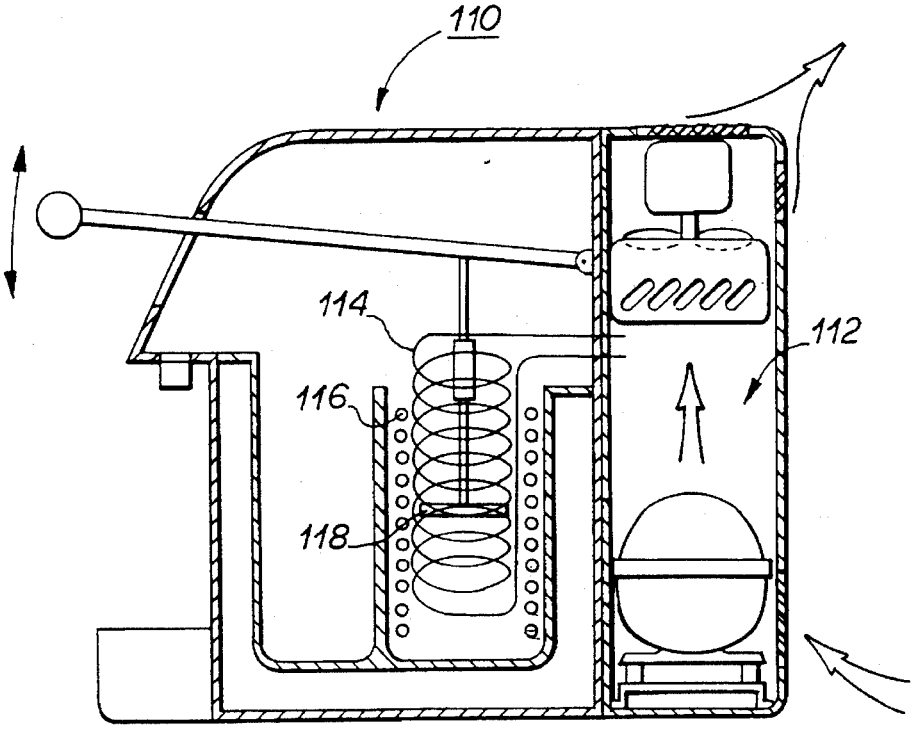
FIG. 10 is a cross-sectional side view through a dispenser similar to that of FIG. 1 but with vapor/compression refrigeration.

FIG. 10 shows another embodiment which can be used to upgrade the basic dispenser 10 of FIGS. 1–5. FIG. 10 shows a dispenser 110 similar to dispenser 10 except that it includes a vapor/compression refrigeration unit 112 with evaporator coils 114 and plumbed water cooling coils 116 in the water tank. A typical agitator can be used in the water tank, or a water agitating plate 118 connected to the pump arm 20 can be used to keep costs down.

Figure 11:
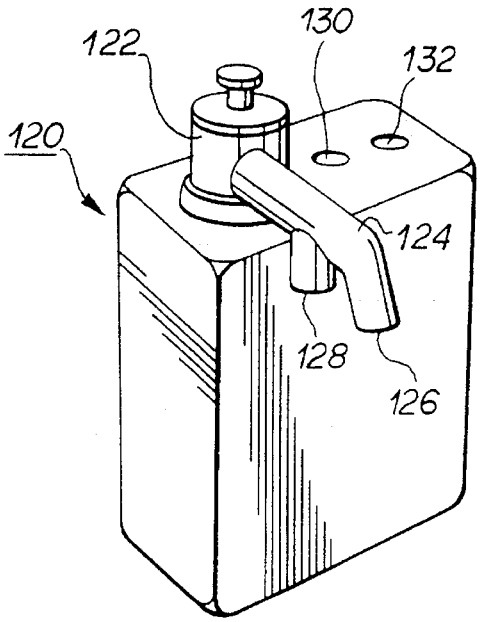
FIG. 11 is a perspective view of a concentrate package with a built-in pump and nozzle according to another embodiment of this invention.
Figure 12:
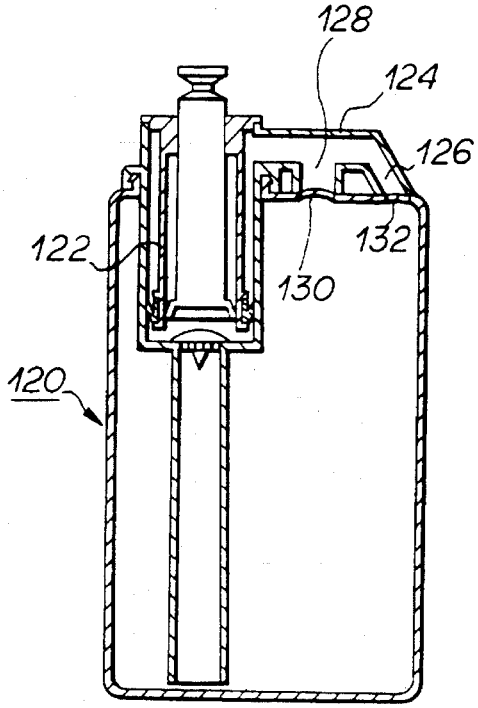
FIG. 12 is a cross-sectional side view through the package and pump of FIG. 11.

FIGS. 11 and 12 show a concentrate container 120 with a built-in pump 122 and a rotatable nozzle 124 having a beverage dispensing opening 126 and a water inlet opening 128. The nozzle nests for shipping with openings 126 and 28 retained on stops 130 and 132.

Figure 13:
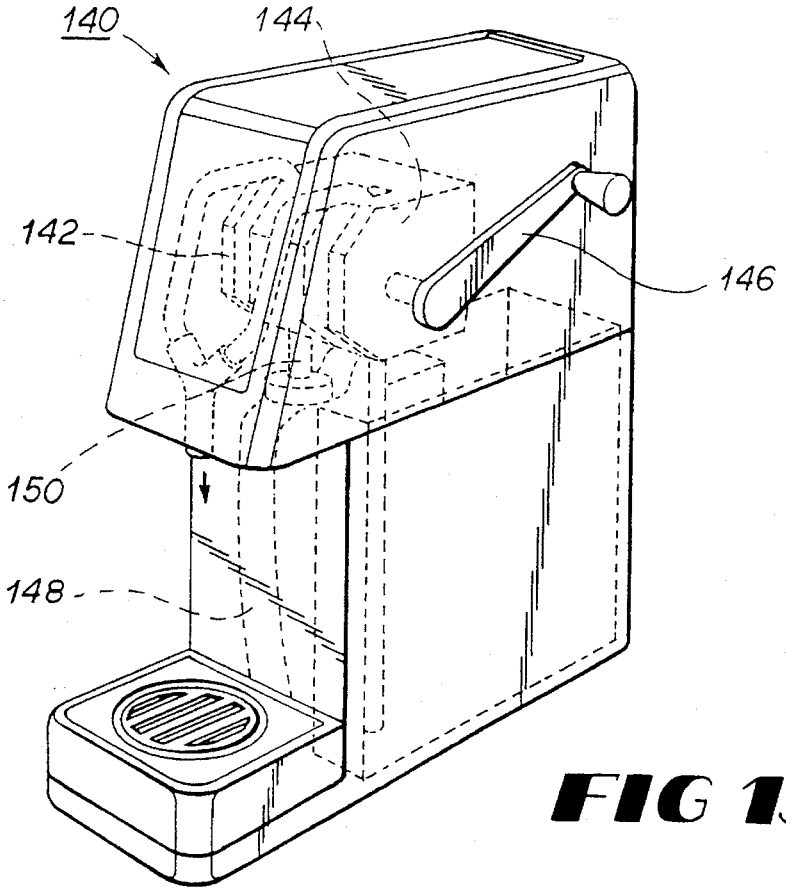
FIG. 13 is a partly broken-away perspective view of a dispenser according to another embodiment of this invention.

FIG. 13 shows a dispenser 140 similar to dispenser 10 except that dispenser 140 uses peristaltic pumps 142 and 144 in place of piston pumps 32 and 36, and uses a rotating pump handle 146 in place of reciprocating pump handle 18. The concentrate container 148 in this embodiment comes with a plastic tube 150 that is inserted into the peristaltic concentrate pump.

Figure 14:
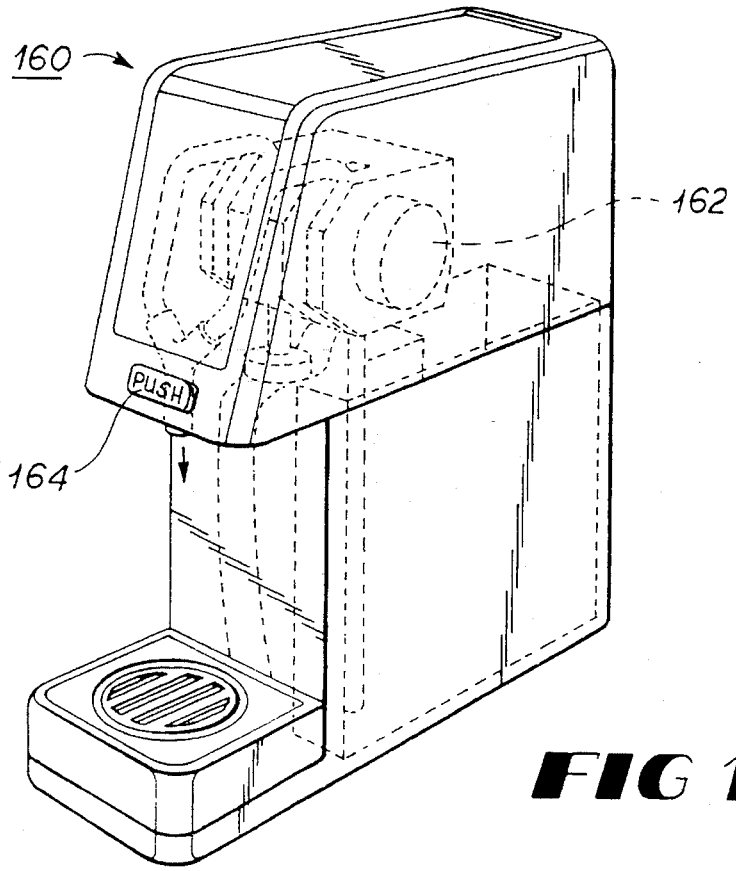
FIG. 14 is a view similar to FIG. 13 but showing a modification thereof using an electric motor in place of the manual pump handle.

FIG. 14 shows a dispenser 160 similar to dispenser 140 of FIG. 13 except that it uses an electric motor 162 in place of the manual handle 146 and a push button 164.

Figure 15:
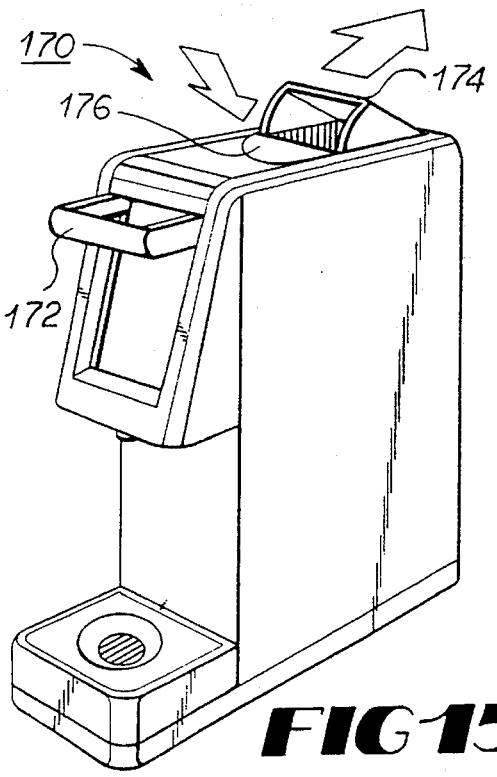
FIG. 15 is a perspective view of a dispenser according to another embodiment of this invention.

FIG. 15 shows a dispenser 170 having a U-shaped handle 172 and an ice and water refill access lid 174 that flips up to open. Water is poured into a depression 176 for ease of filling.

Figure 16:
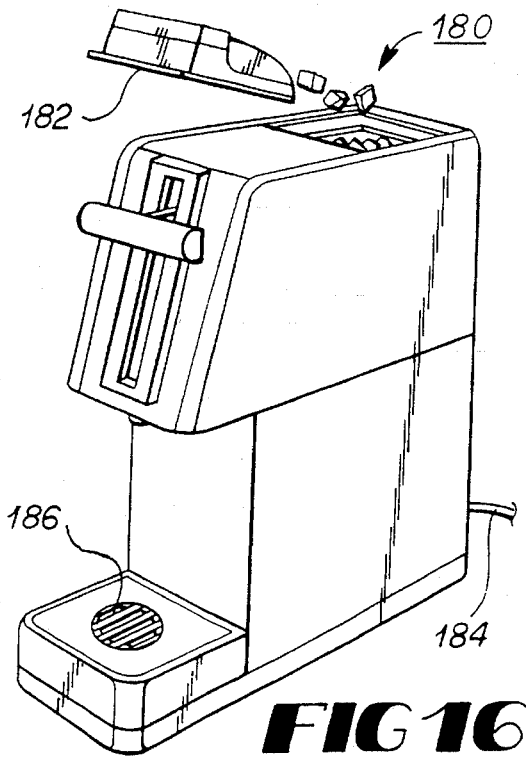
FIG. 16 is a perspective view of a dispenser according to yet another embodiment of this invention.

FIG. 16 shows a dispenser 180 having an ice refill access lid 182 that is removable for use as an ice scoop. The dispenser 180 is plumbed with water line 184 and has a float and valve for controlling the fill level.

Figure 17:
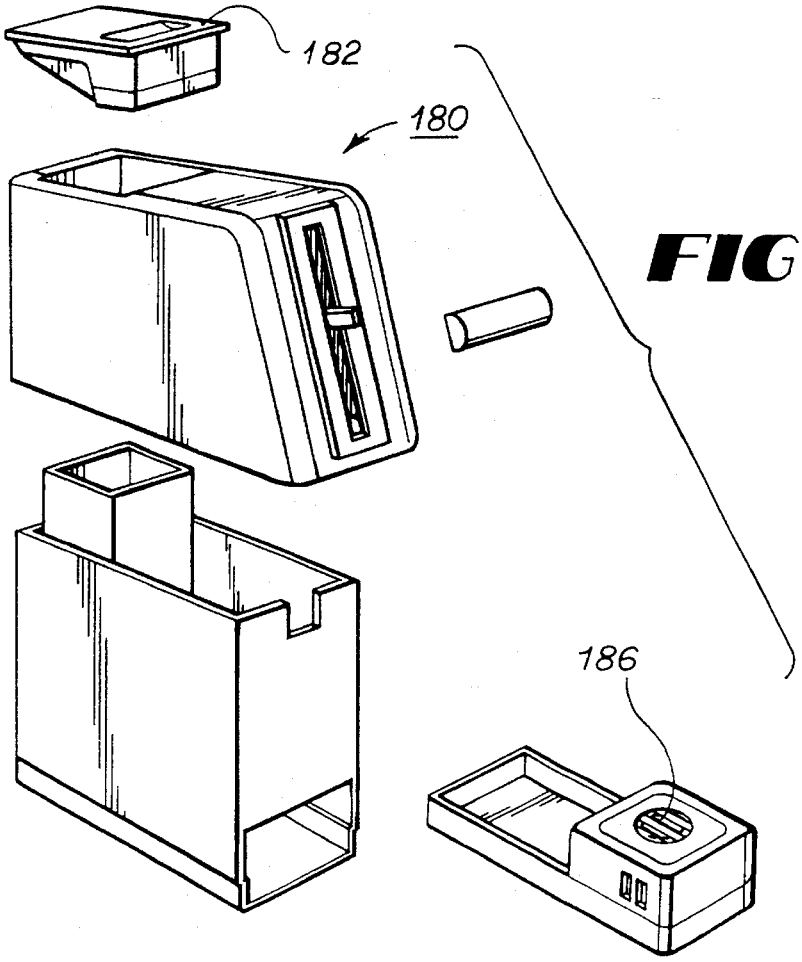
FIG. 17 is a partly exploded perspective view of the dispenser of FIG. 16 showing disassembly thereof for cleaning.

FIG. 17 shows the dispenser 180 with the pans thereof disassembled for cleaning. This disassembly feature is common to all of the different embodiments described herein. FIG. 17 shows the cup rest 186, the lid 182, the cover 188, the water tank 190, and the handle 192.

In addition to piston and peristaltic pumps, other pumps such as bellows and moyno pumps can alternatively be used. Also, they can be different types, for example, a moyno concentrate pump can be used with a peristaltic water pump. The pumps can be separate assemblies or an integral part, for example, of the concentrate package. The water pump can be removable if desired. When using peristaltic pumps, gearing can be used to make pumping easier and in the desired direction. An optional upgrade is to motorize any of the pumps. The concentrate package can be an existing package, a flexible package or a dump tank, for example. Cold plate cooling can be used in place of an open water-bath with ice. The dispenser can be provided with means to connect the water tank to a city water supply. Several dispensers can be connected side by side to provide a plurality of available juices. If an outlet has pre-chilled water, the dispenser can be made smaller.

While the preferred embodiment of this invention has been described above in detail, it is to be understood that variations and modifications can be made therein without departing from the spirit and scope of the present invention.

What is claimed is:

1. A low-cost, postmix, non-carbonated beverage dispenser comprising:

(a) a housing;

(b) said housing including a cup rest;

(c) a beverage dispensing nozzle located above said cup rest for dispensing a beverage into a cup positioned on said cup rest;

(d) a manually operable pump handle extending out through said housing for manual movement thereof for pumping a beverage out through said nozzle;

(e) a removable concentrate container located in said housing;

(f) a water tank located in said housing;

(g) a concentrate pump located in said housing and connected to said pump handle for driving said concentrate pump when said pump handle is manually operated;

(h) a water pump located in said housing and connected to said pump handle fix driving said water pump when said pump handle is manually operated:

(i) said pumps both being volumetric pumps and having a selected ratio of volumes corresponding to the desired mix ratio of water to concentrate to produce a postmix beverage;

(j) said concentrate pump having an inlet connected to said concentrate container and an outlet connected to said nozzle;

(k) said water pump having an inlet connected to said water tank and an outlet connected to said nozzle:

(l) said housing having an access door for allowing ice to be added to said water tank;

(m) said housing having a concentrate container access door for allowing the removal and replacement of concentrate containers; and (n) said dispenser including means for adding water to said water tank.

2. The apparatus as recited in claim 1 wherein said water adding means is a movable lid covering a water access opening whereby water can be manually introduced into said water tank therethrough.

3. The apparatus as recited in claim 1 wherein said lid and said access door are the same member.

4. The apparatus as recited in claim 1 wherein both of said pumps are piston pumps.

5. The apparatus as recited in claim 1 wherein both of said pumps are peristaltic pumps.

6. The apparatus as recited in claim 1 wherein said concentrate pump is built into said concentrate container and is removable therewith.

7. The apparatus as recited in claim 1 wherein said pump handle reciprocates.

8. The apparatus as recited in claim 1 wherein said pump handle rotates.

9. The apparatus as recited in claim 1 wherein said water is ice cooled by loose ice placed into said water tank.

10. The apparatus as recited in claim 1 wherein said dispenser includes vapor/compression refrigeration for cooling water in said tank.

11. The apparatus as recited in claim 1 including an ice refill lid that is removable and when turned upside down is an ice scoop.

12. The apparatus as recited in claim 1 wherein said water adding means is a tilting lid adjacent to a depression in a top surface of said dispenser.

* * * * *